US006261169B1

(12) United States Patent
Ishida et al.

(10) Patent No.: US 6,261,169 B1
(45) Date of Patent: Jul. 17, 2001

(54) COIN PROCESSING DEVICE

(75) Inventors: Takeshi Ishida, Sakado; Ryoji Yamagishi, Kawagoe; Kenji Nakajima, Iruma-gun, all of (JP)

(73) Assignee: Kabushiki Kaisha Nippon Conlux, Tokyo (JP)

( * ) Notice: Subject to any disclaimer, the term of this patent is extended or adjusted under 35 U.S.C. 154(b) by 0 days.

(21) Appl. No.: 09/341,411

(22) PCT Filed: Nov. 9, 1998

(86) PCT No.: PCT/JP98/05050

§ 371 Date: Jul. 9, 1999

§ 102(e) Date: Jul. 9, 1999

(87) PCT Pub. No.: WO99/26206

PCT Pub. Date: May 27, 1999

(30) Foreign Application Priority Data

Nov. 13, 1997 (JP) ..... 9-312201

(51) Int. Cl.[7] ..... G07D 3/00
(52) U.S. Cl. ..... 453/17; 194/350
(58) Field of Search ..... 453/18, 17, 63; 194/350

(56) References Cited

U.S. PATENT DOCUMENTS

| | | | | |
|---|---|---|---|---|
| 2,957,481 | * | 10/1960 | Buchholz | 453/17 |
| 4,460,003 | | 7/1984 | Barnes et al. . | |
| 5,400,891 | | 3/1995 | Winstanley | 194/350 |
| 5,468,181 | * | 11/1995 | Ishida et al. | 453/17 X |
| 5,501,633 | * | 3/1996 | Watkins et al. | 453/17 |

FOREIGN PATENT DOCUMENTS

| | | | | |
|---|---|---|---|---|
| 2805978 | * | 8/1979 | (DE) | 453/17 |
| 58-019647 | | 4/1983 | (JP) | F24J/3/00 |

* cited by examiner

*Primary Examiner*—F. J. Bartuska
(74) *Attorney, Agent, or Firm*—Hogan & Hartson L.L.P.

(57) ABSTRACT

A coin processing device is capable of accommodating a maximum number of coin tubes within a predetermined width. The coin processing device includes a device body (2), a coin sorting mechanism (3) for checking an inserted coin and identifying the kind of coin inserted, and a coin dispensing mechanism (39) for storing the identified coins according to the kind of coin and for selecting and dispensing coins for change. The coin dispensing mechanism (39) includes a coin accommodating device (34) that can accommodate many kinds of coins, sorted by kind, within a predetermined width (L).

2 Claims, 6 Drawing Sheets

COIN PROCESSING DEVICE

TECHNICAL FIELD

This invention relates to a coin processing device, used in automatic vending machines, money changing machines and service equipment, etc., that sorts and holds inserted coins by denomination and that pays out the sorted and held coins as change, and more particularly, to improvements in coin accommodating means for temporarily holding sorted genuine coins by denomination.

BACKGROUND ART

Conventional automatic vending machines, money changing machines, and service equipment, etc., have been equipped with coin processing devices that sort and hold inserted coins by denomination and pay out sorted and held coins as change.

FIG. 3 is a schematic perspective view of a conventional coin processing device 1.

The coin processing device 1 comprises the following two main constituting elements.

The first constituting element comprises coin sorting means 3 that sorts inserted coins by genuine and counterfeit and then the genuine coins by denomination. The coin sorting means 3 is mounted in the upper part of a device body 2 having a roughly H-shaped cross-section and constituting the frame of the coin processing device 1 in such manner that it can be freely mounted and removed.

The second constituting element comprises coin dispensing means 9 that stores the sorted genuine coins by denomination and that sorts and pays out the stored genuine coins according to the change amount. The coin dispensing means 9 is located in the lower portion of the device body 2, and comprises four coin tubes 5, 6, 7, and 8 having different diameters except in part, which are lined up in a row.

These four coin tubes 5, 6, 7, and 8 are loaded inside the device body 2 so that they can be freely loaded and unloaded. Of these four, coin tubes 5, 6 and 7 are positioned directly below the coin sorting means 3 when they are loaded into the device body 2. The coin tube 8, is a supplemental tube wherein coins that are used with particularly high frequency are stored beforehand, the diameter of which is set to be the same as that of the coin tube 6.

Reference number 10 in FIG. 3 is a control switch group (inventory switch group) for giving directions such as a payment direction when forcing the payment of certain denominations of the coins stored in the coin dispensing means 9 for each denomination. The control switch group 10 is positioned inside a switch box 11 provided at the upper right of the device body 2.

By means of such a coin processing device 1, coins first pass through a coin insertion hopper 12 into the coin sorting means 3 where they are sorted according to genuine and counterfeit and according to the denomination of the genuine coins. Of these coins, the genuine coins are sorted and stored in the coin tubes 5, 6 and 7 constituting the coin dispensing means 9.

When the denominations of the change are specified, the coins stored in the coin tubes 5, 6, 7 and 8 are selected and paid out according to the change amount.

The conventional coin processing device 1 described above, however, is loaded in the limited space inside an automatic vending machine or other equipment. Therefore, the overall size thereof is strictly specified beforehand. In particular, as indicated in the enlarged perspective cross-sectional view of the coin tubes 5, 6, 7 and 8 constituting the coin dispensing means 9 and device body 2 in FIG. 4, the width L of the device body 2 is strictly specified.

When, on the other hand, the coin processing device 1 described above is used in countries wherein different numbers of coin denominations having different diameters are used, it becomes particularly necessary to employ a larger number of the coin tubes that are lined up to constitute the coin dispensing means 9.

However, the coin tubes 5, 6, 7 and 8 that are lined up together to constitute the conventional coin dispensing means 9 are arranged in a configuration wherein the line A that connects the axial centers a, b, c and d of the coin tubes 5, 6, 7 and 8, forms a straight line, as depicted in the top view in FIG. 5. Therefore, when another coin tube 11 having a still different diameter is lined up so that the line B that connects the axial centers a, b, c, d and e forms a straight line, the overall width L1 of the coin tubes 5, 6, 7, 8 and 11 will be larger than the width L of the device body 2 (i.e. L1>L). Therefore, the coin tubes 5, 6, 7, 8 and 11 cannot be accommodated inside the device body 2. This presents a problem.

Reference number 12 in FIGS. 4 to 6 is a control board positioned on the back side of the coin tubes 5, 6, 7 and 8 inside the device body 2. On the control board 12 are mounted not only electronic components for controlling the drives of various kinds of electronic equipment (such as solenoid plungers, etc., for driving coin sorting levers) located inside either the coin sorting means 3 or coin dispensing means 9, as described above, but also, as depicted in FIGS. 5 and 6, empty sensors 20, 21, 22, 23 and 24 for detecting whether or not coins are presently stored in the coin tubes 5, 6, 7, 8 and 11.

These empty sensors 20, 21, 22, 23 and 24 comprise electromagnetic coil proximity switches that detect whether or not any coins are being held in the coin tubes 5, 6, 7, 8 and 11 by detecting changes in inductance. However, the distances D1, D2, D3, D4 and D5 between the inner walls of the coin tubes 5, 6, 7, 8 and 11 and the corresponding empty sensors 20, 21, 22, 23 and 24, respectively, differ from one another. Therefore, there is a danger of variation developing in the sensitivities with which the presence of coins in the coin tubes is detected by the corresponding empty sensors 20, 21, 22, 23 and 24, if no sensitivity adjustments are made. In order to compensate for this, sensitivity adjustments are made beforehand so that the sensitivities with which the presence of coins is detected by the empty sensors 20, 21, 22, 23 and 24 are equalized.

Accordingly, an object of the present invention is to provide a coin processing device wherein many coin tubes can be accommodated within a specific width.

DISCLOSURE OF THE INVENTION

According to the present invention, the coin processing device wherein coin sorting means for determining whether inserted coins are genuine and for sorting genuine coins by denomination; and coin dispensing means for holding sorted genuine coins by denomination and for selecting and paying out held genuine coins according to change amounts are disposed in a device body, is characterized in that the coin dispensing means comprises coin accommodating means for holding an larger number of denominations of genuine coins by denomination within a specific width.

With this configuration, even when the number of coin tubes that constitute the coin dispensing means is increased, it is possible to maximally suppress an expansion in the total width of the coin tubes, thus making it possible to accommodate many coin tubes within the device body of a given width.

Further, because it is possible to accommodate many coin tubes within the device body of a given width, when coin tubes are installed inside the device body in accord with the number of coins used and the different diameters in each country's coinage, it is possible to install a plurality of coin tubes, corresponding to each country, inside main apparatus bodies of the same scale, without altering the size of the device body.

BEST MODE FOR CARRYING OUT THE INVENTION

The attached drawings are now used in describing the present invention in greater detail.

Detailed descriptions are given below of embodiments of the coin processing device according to the present invention.

Figure 1:
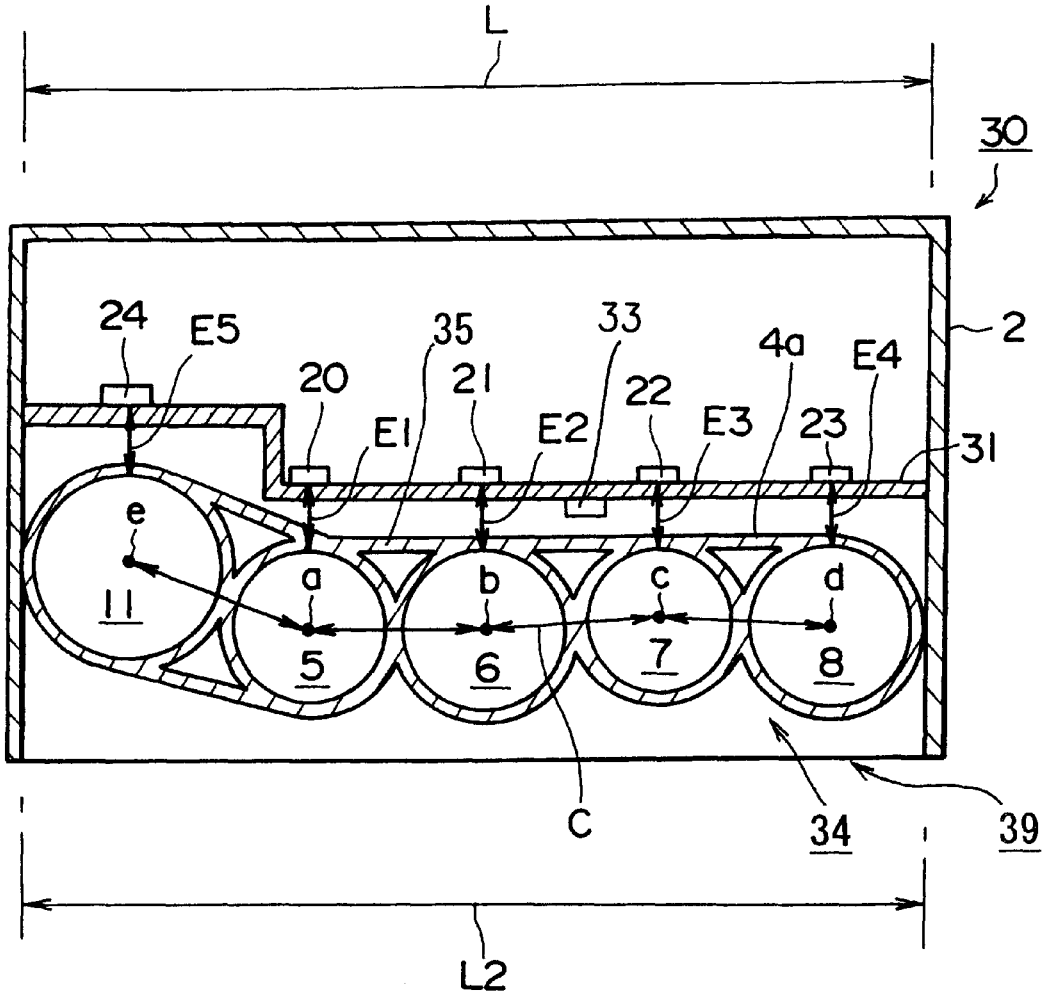
FIG. 1 is a schematic cross-sectional view of a coin processing device in a first embodiment of the present invention.
Figure 5:
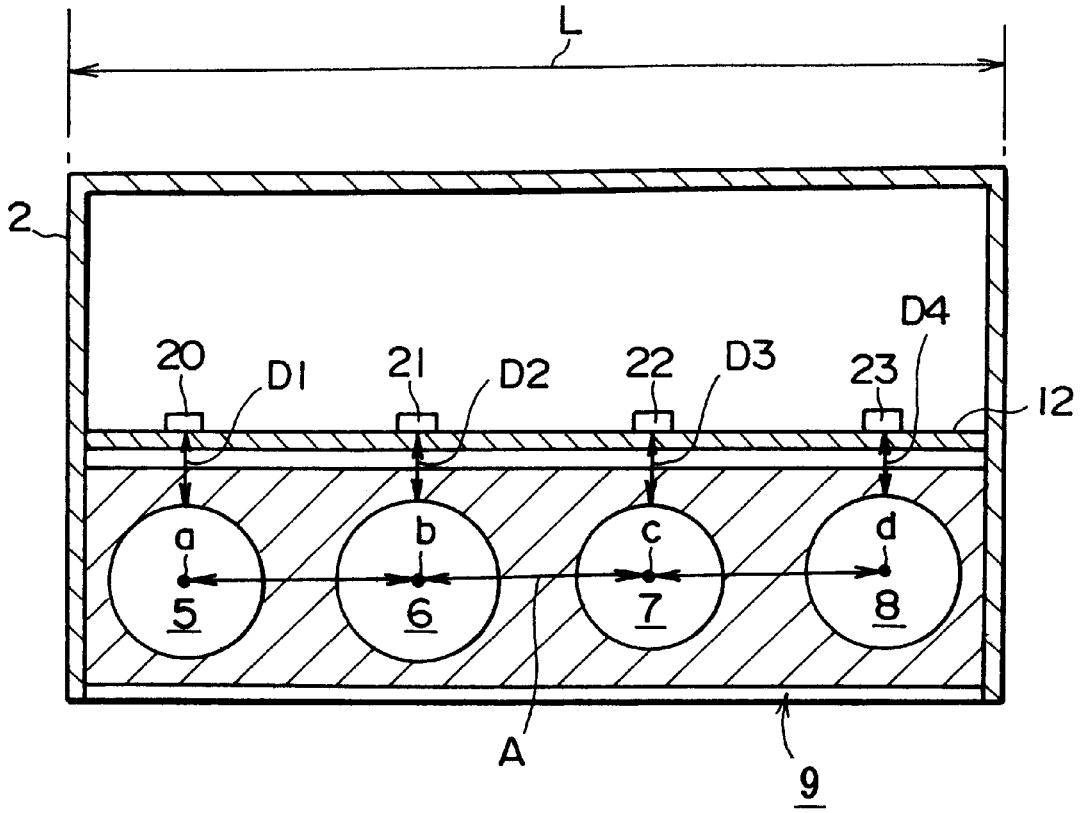
FIG.5 PRIOR ART
FIG. 5 is a schematic cross-sectional view of a conventional coin processing device.
Figure 6:
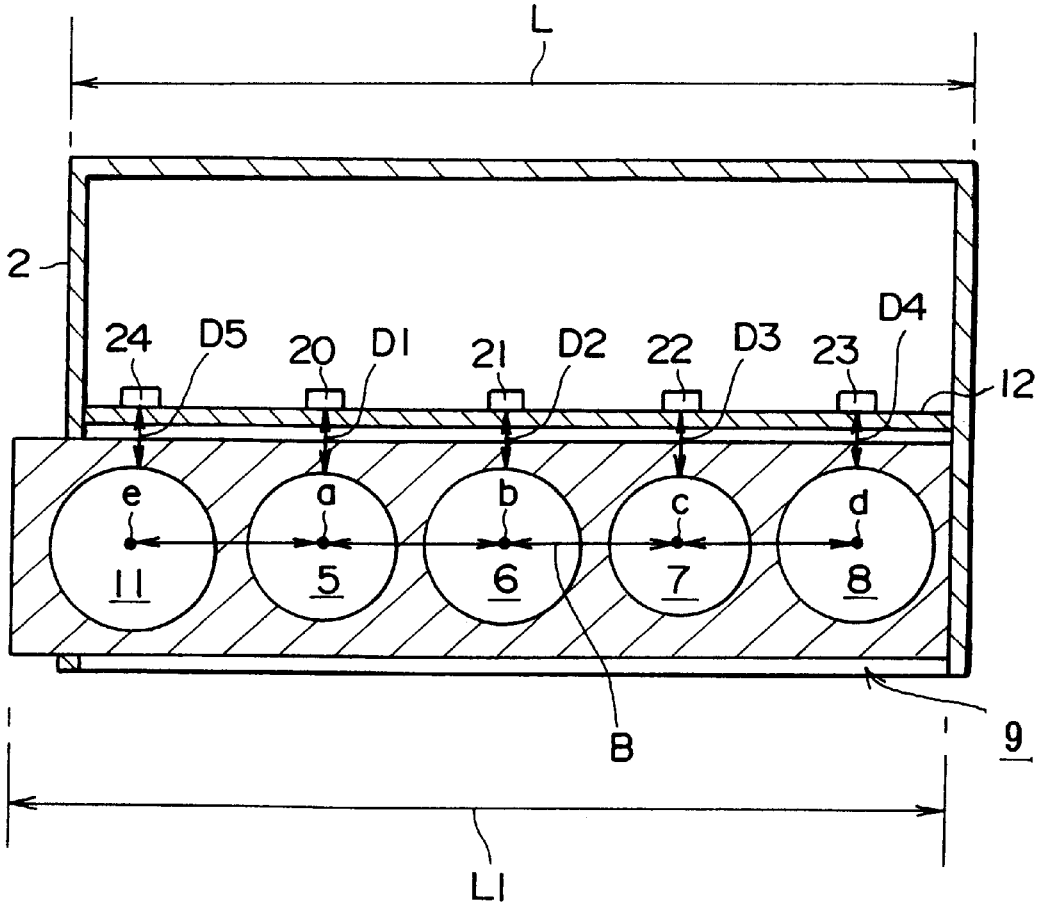
FIG.6 PRIOR ART
FIG. 6 is a schematic cross-sectional view of a conventional coin processing device wherein the number of coin tubes has been increased by one.

FIG. 1 is a cross-sectional view of a coin processing device 30 in a first embodiment of the present invention, wherein parts that are the same as those in FIGS. 5 and 6 are designated by identical symbols.

In the coin processing device 30 in the first embodiment, five coin tubes 5, 6, 7, 8 and 11 are integrally formed, and are positioned, as seen from the top, so that a line C connecting the axial centers a, b, c, d and e thereof forms a line that bends to the right and to the left, that is to say, forms a zigzag line. In particular, the line extending from the axial center a of the coin tube 5 positioned on the left side of the drawing and connecting the axial center e of the coin tube 11 of maximum diameter positioned at the extreme left adjacent to the coin tube 5 bends sharply in the clockwise direction.

The plurality of coin tubes 5, 6, 7, 8 and 11 lined up so that the line C connecting the axial centers a, b, c, d and e thereof forms a zigzag line, as seen from above, constitute coin accommodating means 34 that can store a greater variety of genuine coins, by denomination, within a certain width L. The coin accommodating means 34 constitutes coin dispensing means 39 that holds sorted genuine coins by denomination and selects and pays out held genuine coins according to change amounts.

Thus, in the coin processing device 30 of the first embodiment, the coin dispensing means 39 is designed so as to comprise coin accommodating means 34 made up of coin tubes 5, 6, 7, 8 and 11 lined up so that the line C connecting their axial centers a, b, c, d and e forms a zigzag line, as seen from above. Therefore, the widths between adjacent coin tubes, in the coin tubes 5, 6, 7, 8 and 11, are narrowed, and the total width L2 of the coin tubes 5, 6, 7, 8 and 11 is formed so as to be narrower than the total width L1 of the conventional coin tubes 5,6,7,8 and 11, as depicted in FIG. 6 (i.e. L2<L1). As a consequence, the total width L2 of the coin tubes 5, 6, 7, 8 and 11 arranged such that the line C connecting the axial centers a, b, c, d and e thereof forms a zigzag line, as depicted in FIG. 1, can be set equal to or less than the width L of the device body 2 (i.e. L2≦L), making it possible to install the five coin tubes 5, 6, 7, 8 and 11 inside the device body 2.

In other words, in the coin processing device 30 of the first embodiment, the coin dispensing means 39 comprises the coin accommodating means 34, and the coin accommodating means 34 comprises the coin tubes 5, 6, 7, 8 and 11 lined up so that the line C connecting the axial centers a, b, c, d and e thereof forms a zigzag line, as seen from above. Therefore, even when the number of coin tubes used is increased from the conventional four tubes to five, as depicted in FIG. 1, the expansion of the total width L2 of the coin tubes 5, 6, 7, 8 and 11 can be suppressed. It is therefore possible to accommodate the five coin tubes 5, 6, 7, 8 and 11 inside the device body 2 having a given width L.

In the coin processing device 30 of the first embodiment, furthermore, although five coin tubes 5, 6, 7, 8 and 11 are accommodated inside the device body 2 of given width L, even when the number of coin tubes used is increased above five, it is possible to suppress the expansion of the total width L2 of the coin tubes loaded inside the device body 2, by the coin accommodating means 34 of the above configuration. Thus, many coin tubes can be accommodated inside a device body 2 of given width L.

Accordingly, with the coin processing device 30 represented in the first embodiment of the present invention, when coin tubes are installed in the device body 2 according to the coinage of various countries wherein the number of coins used and the diameters thereof differ, it is possible to install a plurality of coin tubes, corresponding to each country, in main apparatus bodies 2 of the same scale, without altering the size of the device body 2.

When the coin dispensing means 39 comprises coin accommodating means 34 made up of coin tubes 5, 6, 7, 8 and 11 lined up so that the line C connecting their axial centers a, b, c, d and e forms a zigzag line, as seen from above, as in the coin processing device 30 in the first embodiment, the distances E1, E2, E3 and E4 between the inner walls of the coin tubes 5, 6, 7 and 8 and the empty sensors 20, 21, 22 and 23 that detect the presence of genuine coins inside the coin tubes 5, 6, 7 and 8 can be made the same (i.e., E1=E2=E3=E4).

The empty sensors 20, 21, 22 and 23 are positioned on a control board 31 corresponding to the coin tubes 5, 6, 7 and 8, respectively, and the control board 31 is installed in the device body 2 positioned in back of the coin tubes 5, 6, 7 and 8.

More specifically, when a plurality of coin tubes of differing diameters are lined up, these tubes are arranged so that the line connecting their axial centers a, b, c, d and e does not coincide with a straight line, but, instead, the line C connecting their axial centers a, b, c, d and e forms a zigzag line, as depicted in FIG. 1. With this configuration, the coin tubes 5, 6, 7 and 8 can be integrally formed, with the distances from the back surfaces of the coin tubes 5, 6, 7 and 8 to the inner walls of the coin tubes 5, 6, 7 and 8 made to be equal. In other words, it is possible to make the distances E1, E2, E3 and E4 between the inner walls of the coin tubes 5, 6, 7 and 8 and the corresponding empty sensors 20, 21, 22 and 23 disposed on the control board 31 positioned in parallel relative to the back surfaces of the coin tubes 5, 6, 7 and 8, respectively, the same distance. It therefore becomes possible to reduce occurrences of variation in the sensitivity with which the presence of coins held in the coin tubes 5, 6, 7 and 8 is detected by the empty sensors 20, 21, 22 and 23 due to the variation of distance between the inner walls of these coin tubes and the respective empty sensors.

In the coin processing device 30 of the first embodiment, five coin tubes 5, 6, 7, 8 and 11 are accommodated in a device body 2 of given width L. However, as noted already, with the coin processing device of the present invention, the coin accommodating means comprising a plurality of coin tubes, according to the numbers and disparate diameters of coins used by different countries, can be installed inside main apparatus bodies 2 of the same scale, without altering the size of the device body 2. For example, in order to conform to the coinage of different countries, coin tubes having inner diameters differing from those of the coin tubes 5, 6, 7, 8 and 11 depicted in FIG. 1 can be loaded in the device body 2, as depicted in FIG. 2, wherein parts that are the same as those in FIG. 1 are identified by the same symbol.

Figure 2:
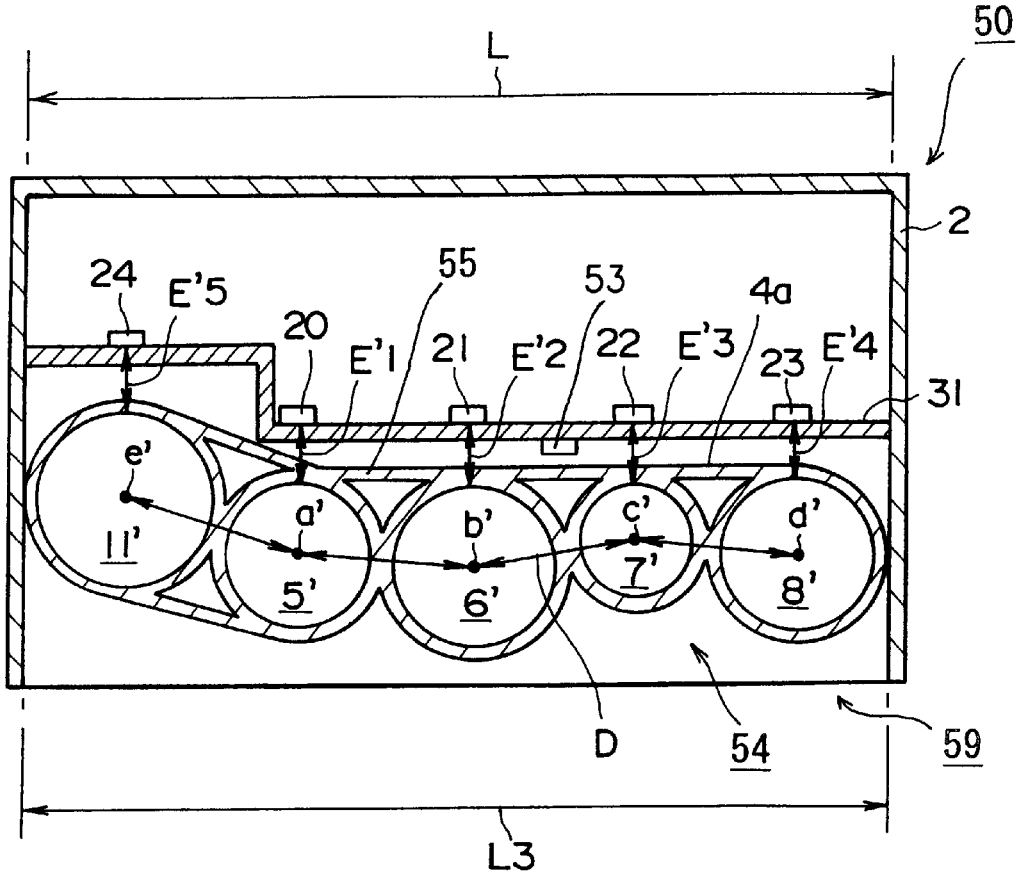
FIG. 2 is a schematic cross-sectional view of a coin processing device in a second embodiment of the present invention.
Figure 3:
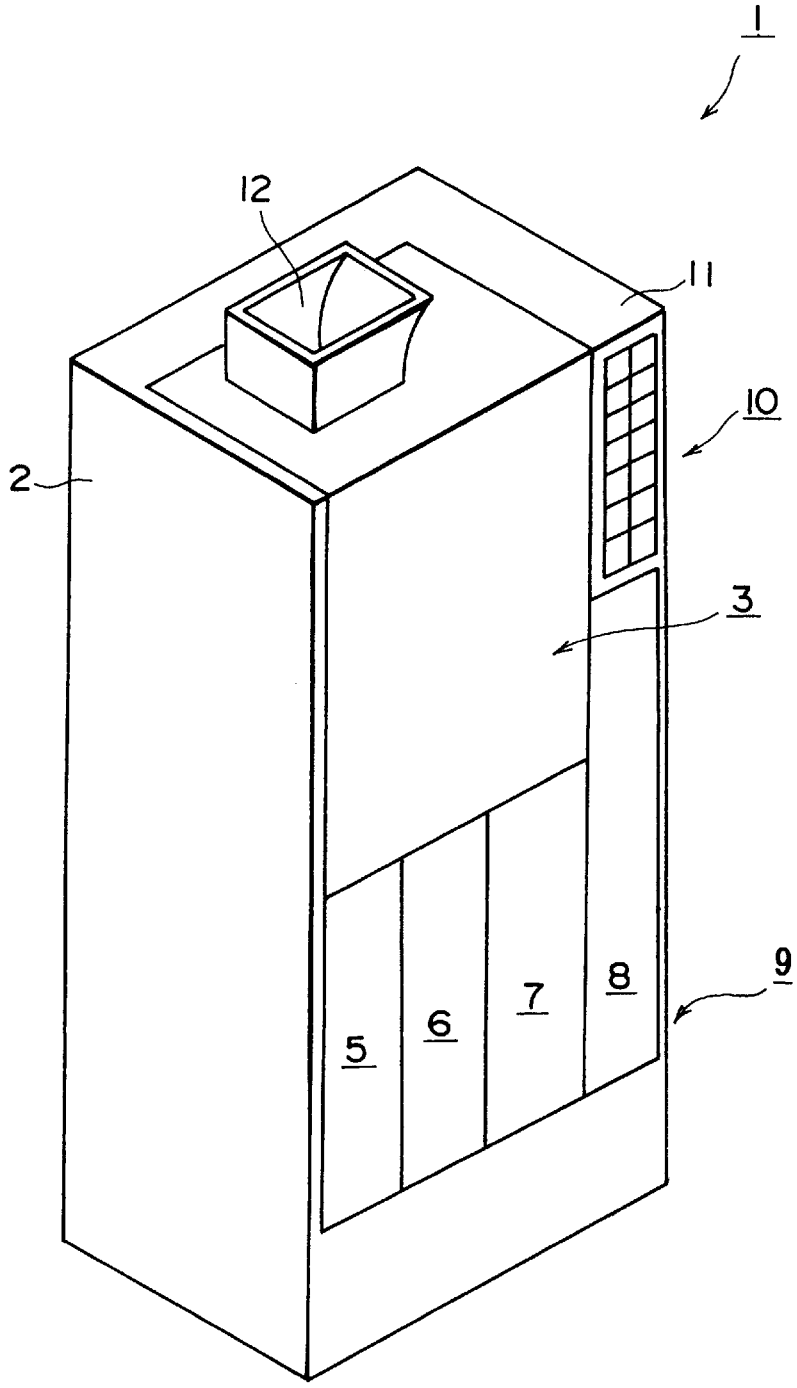
FIG.3 PRIOR ART
FIG. 3 is a schematic perspective view of a conventional coin processing device.
Figure 4:
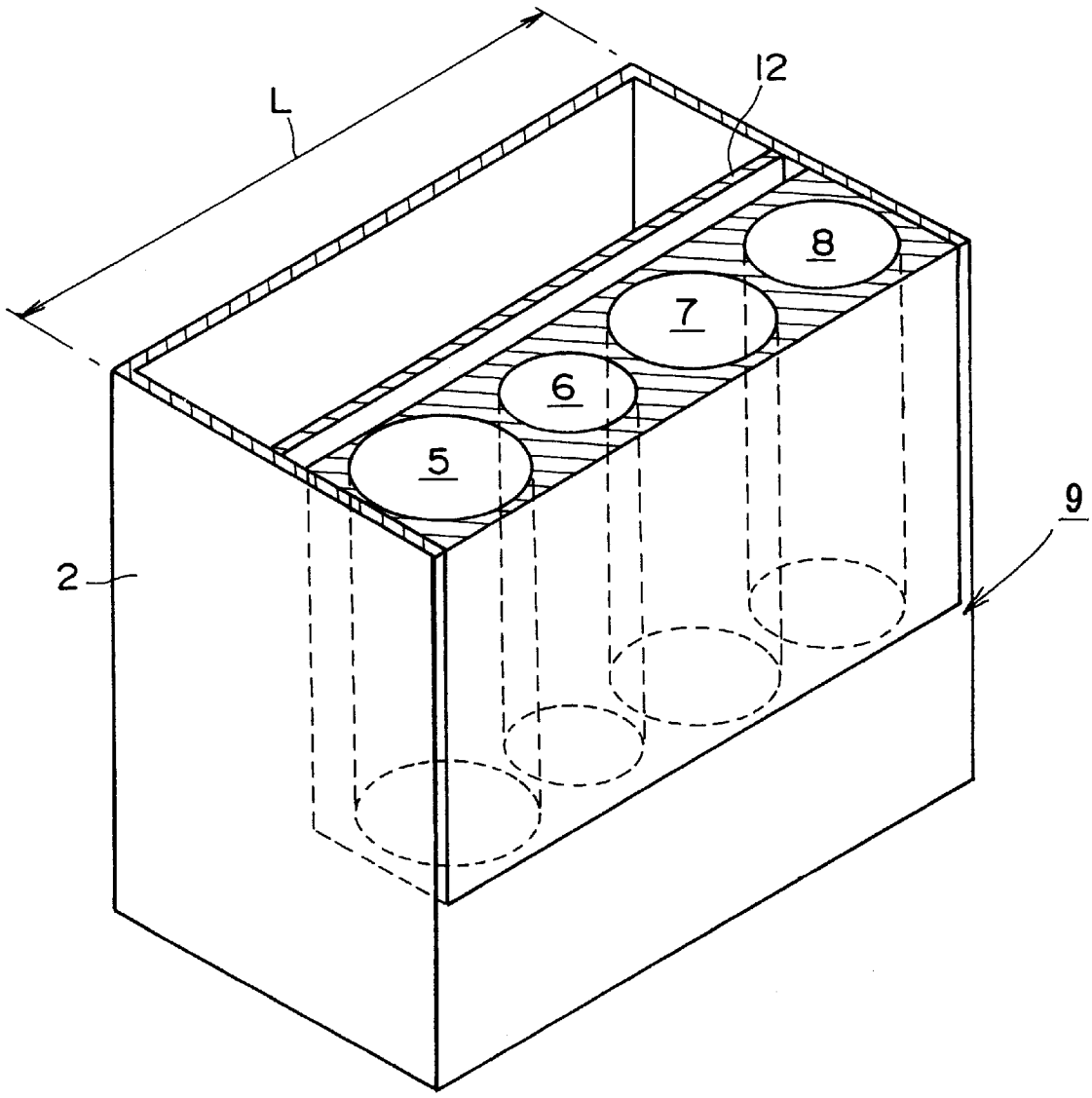
FIG.4 PRIOR ART
FIG. 4 is a schematic perspective cross-sectional view of a conventional coin processing device.

The coin processing device 50 depicted in FIG. 2 is a coin processing device in a second embodiment of the present invention, wherein, according to the coinage of another country wherein the diameters are different, coin tubes 5', 6', 7', 8 and 11' having inner diameters differing from those of the coin tubes 5, 6, 7, 8 and 11 in FIG. 1 are loaded into a device body 2.

In the coin processing device 50 in the second embodiment, five coin tubes 5', 6', 7', 8' and 11', integrally formed, are lined up in an arrangement wherein a line D connecting the axial centers a', b', c', d' and e' of the coin tubes 5', 6', 7', 8' and 11', respectively, is a line that bends to the right and to the left, that is, forms a zigzag line.

Furthermore, the plurality of coin tubes 5', 6', 7', 8' and 11', lined up so that the line D connecting their axial centers a', b', c', d' and e' forms a zigzag line, as seen from above, constitutes coin accommodating means 54 that accommodates an even greater variety of genuine coins, by denomination, within a given width L. The coin accommodating means 54 constitutes coin dispensing means 59 that holds the sorted genuine coins by denomination and that pays out the held genuine coins according to change amounts.

In the coin processing device 50 in the second embodiment, with the coin accommodating means 54, the distances E'1, E'2, E'3 and E'4 between the inner walls of the coin tubes 5', 6', 7' and 8' and corresponding empty sensors 20, 21, 22 and 23, respectively, can be made the same (i.e., E'1=E'2=E'3=E'4), and the distances E'1, E'2, E'3 and E'4 can be made the same distance as the distances E1, E2, E3 and E4 between the inner walls of the coin tubes 5, 6, 7 and 8 and the empty sensors 20, 21, 22 and 23 depicted in FIG. 1 (i.e., E1=E2=E3=E4=E'1=E'2=E'3=E'4). Therefore, even when coin tubes 5', 6', 7' and 8' having diameters different from those of the coin tubes 5, 6, 7 and 8 are loaded into the same device body 2, in coping with the coinage of various countries, no variation will develop in the sensitivity wherewith the empty sensors 20, 21, 22 and 23 detect the presence of coins in the corresponding coin tubes 5', 6', 7' and 8'. Therefore, the presence of coins held inside the corresponding coin tubes 5', 6', 7' and 8' can be detected reliably.

It is possible, furthermore, to set the distance E5 between the inner wall of the coin tube 11 and the empty sensor 24 depicted in FIG. 1 to be the same as the distance E'5 between the inner wall of the coin tube 11' and the empty sensor 24 depicted in FIG. 2 (i.e. so that E5=E'5). Therefore, no variance will develop in the sensitivity wherewith the empty sensor 24 detects the presence of coins held in the corresponding coin tubes 11 and 11', respectively. Therefore, even when coin tubes 5', 6', 7', 8' and 11' having diameters made different from those of the coin tubes 5, 6, 7, 8 and 11 are employed, it becomes possible to stably detect the presence of coins held inside the corresponding coin tubes 5', 6', 7', 8' and 11'.

With the coin dispensing means 59 that is provided with coin accommodating means 54, the total width L3 of the coin tubes 5', 6', 7', 8' and 11' can be set so as to be equal to or less than the width of the device body 2 (i.e. so that L3≦L).

Also, although when a coin tube group 35 wherein the coin tubes 5, 6, 7, 8 and 11 are integrally formed, or a coin group 55 wherein the coin tubes 5', 6', 7', 8' and 11' are integrally formed, is loaded inside the device body 2, identification means 33,53 for identifying the type of coin tube group, that is, means for identifying whether the coin tube group loaded is of the type of the coin tube group 35 depicted in FIG. 1, or of the coin tube group 55 depicted in FIG. 2, or of some other coin tube group different from either the coin tube group 35 or the coin tube group 55, are provided in the control board 31 indicated in FIGS. 1 and 2.

Such other type of coin tube group might be, for example, a coin tube group comprising coin tubes having diameters differing from those of the coin tubes described in the foregoing, or a coin tube group wherein some number of coin tubes other than five is integrally formed.

The identification means 33,53 may comprise a cassette identification sensor constituted, for example, with three linked switches provided in the control board 31 and projections (not shown) projecting from the back surface of the coin tube groups 35 and 55 that depress one or other of the three linked switches.

In the case of such a cassette identification sensor, when the coin tube group 35 is loaded in the device body 2 depicted in FIG. 1, the projection could activate the uppermost of the three linked switches, whereas when the coin tube group 55 is loaded in the device body 2, the middle switch of the three linked switches could be activated. Thus, by varying the position where the projection is formed in the respective types of coin tube group, it would be easy to detect which type of coin tube group has been loaded in the device body 2, thereby making it possible to automatically switch the control of the sorting functions, etc., based on detection signals therefrom, so as to accord with the coins stored in each type of coin tube group.

With the coin processing devices 30 and 50 in the first and second embodiments, respectively, the coin tube groups have five coin tubes lined up therein, but the number of such coin tubes is not limited thereto, and may be made whatever number will accord with the number of coins used and the diameters thereof, depending on the country.

INDUSTRIAL APPLICABILITY

The coin processing device according to the present invention, as described in the foregoing, is useful for applications in automatic vending machines, money changing machines and service equipment, etc., as a coin processing device for sorting and storing the inserted coins by denomination, and paying out the sorted and stored coins as change, and is particularly well suited for use as a coin processing device wherewith many coin tubes can be accommodated within a given width.

What is claimed is:

1. A coin processing device comprising:

a device body (2);

coin sorting means (3) disposed in the device body (2) for determining whether inserted coins are genuine or counterfeit and for sorting genuine coins by denomination;

coin dispensing means (39) disposed in the device body (2) for holding sorted genuine coins by denomination and for selecting and paying out held genuine coins according to change amounts, the coin dispensing means (39) comprising:

coin accommodating means (34) for holding a larger number of denominations of genuine coins by denomination within a specific width (L), wherein the coin accommodating means (34) comprises a plurality of integrally formed coin tubes (5, 6, 7, 8, 11) constituting a coin tube group (35) disposed in the device body (2) so as to be freely loaded and unloaded, the plurality of coin tubes (5, 6, 7, 8, 11) disposed so that a line (C) connecting their axial centers (a, b, c, d, e) forms a zigzag as seen from above;

a control board (31) disposed in the device body (2) at a back side of the coin tube group (35); and electromagnetic coil proximity switches for detecting presence and absence of genuine coins stored in a portion of the coin tubes provided at positions corresponding to a portion of the coin tubes along a straight line as viewed from above, wherein, when the coin tube group (35) is loaded in the device body (2), a portion of the coin tubes of the coin tube group (35) are disposed so that distances from closest portions of inner walls of a portion of the coin tubes to corresponding proximity switches are the same.

2. The coin processing device according to claim 1, further comprising identification means disposed in the device body (2), for identifying a type of the coin tube group (35) currently loaded in the device body (2).

* * * * *